US006585494B1

(12) United States Patent
Suzuki

(10) Patent No.: US 6,585,494 B1
(45) Date of Patent: Jul. 1, 2003

(54) VARIABLE-CAPACITY CONTROL FOR REFRIGERATING CYCLE WITHOUT USING A LARGE PRESSURE CONTROL VALVE

(75) Inventor: Nobuhiko Suzuki, Konan (JP)

(73) Assignee: Zexel Valeo Climate Control Corporation, Saitama (JP)

( * ) Notice: Subject to any disclaimer, the term of this patent is extended or adjusted under 35 U.S.C. 154(b) by 0 days.

(21) Appl. No.: 09/980,499

(22) PCT Filed: Mar. 24, 2000

(86) PCT No.: PCT/JP00/01807

§ 371 (c)(1),
(2), (4) Date: Dec. 4, 2001

(87) PCT Pub. No.: WO01/00992

PCT Pub. Date: Jan. 4, 2001

(30) Foreign Application Priority Data

Jun. 24, 1999 (JP) ..... 11-178036

(51) Int. Cl.[7] ..... F04B 1/26

(52) U.S. Cl. ..... 417/222.2; 62/114; 62/498; 251/129.5

(58) Field of Search ..... 417/222.2, 222.7; 62/114, 115, 228.1, 228.5, 467, 498; 251/129.5, 282

(56) References Cited

U.S. PATENT DOCUMENTS 6,092,379 A * 7/2000 Nishida et al. ..... 62/200

FOREIGN PATENT DOCUMENTS

| | | | |
|---|---|---|---|
| JP | 361286591 A | * | 12/1986 |
| JP | 63-148062 | | 6/1988 |
| JP | 2-135680 | | 11/1990 |
| JP | 5-99136 | | 4/1993 |
| JP | 5-231312 | | 9/1993 |
| JP | 7-151261 | | 6/1995 |
| JP | 9-151847 | | 6/1997 |
| JP | 9-166086 | | 6/1997 |
| JP | 9-250452 | | 9/1997 |
| JP | 10-141242 | | 5/1998 |
| JP | 10-318405 | | 12/1998 |

* cited by examiner

*Primary Examiner*—Charles G. Freay
*Assistant Examiner*—J F Belena
(74) *Attorney, Agent, or Firm*—Wenderoth, Lind & Ponack, L.L.P.

(57) ABSTRACT

Variable-capacity control is reliably carried out without using a large pressure control valve while maintaining sufficient pressure resistance in a refrigerating cycle in which carbon dioxide is used as its coolant. A pressure sensor for measuring the pressure on the low pressure side of this refrigerating cycle is used. The electromagnetic coil of the pressure control valve is controlled so that the measured pressure approaches the target value. Low pressure is applied equally to both ends in the direction of movement of the valve disc of the pressure control valve, so that the valve disc can be moved by a light load, and hence the size of the electromagnetic coil can be small.

22 Claims, 6 Drawing Sheets

VARIABLE-CAPACITY CONTROL FOR REFRIGERATING CYCLE WITHOUT USING A LARGE PRESSURE CONTROL VALVE

TECHNICAL FIELD

The present invention relates to a variable-capacity control apparatus to be employed in conjunction with a refrigerating cycle which uses carbon dioxide as the coolant and includes a variable-capacity compressor provided with a swash plate tiltably secured to a drive shaft and a piston caused to move reciprocally inside a compression space as the drive swash plate rotates to vary the capacity for the coolant flowing through the refrigerating cycle by varying the piston stroke in correspondence to the tilt angle of the drive swash plate based upon the difference between the pressure in the compression space and the piston back pressure.

BACKGROUND ART

The pressure control valve used in the variable-capacity swash plate compressor disclosed in Japanese Unexamined Patent Publication No. H 5-99136 includes a first control valve that implements open/close control on the communication between an outlet chamber and a crank case, a second control valve that implements open/close control on the communication between the crank case and an intake chamber, a transmission rod that engages the first and second control valve in operation, an electromagnetic actuator that moves the transmission rod and the pressure-sensitive member (such as a diaphragm or a bellows) that engages the second control valve in operation by sensing the pressure within the intake chamber.

The control valve for a variable-capacity compressor disclosed in Japanese Unexamined Patent Publication No. H 9-268974 comprises a valve element that opens/closes an air supply passage communicating between an outlet pressure area and a crank case, a pressure-sensitive unit that is linked to one side of the valve element via a pressure-sensitive rod to achieve interlocked operation and is housed within a pressure-sensitive chamber communicating with an intake pressure area to apply a force to the valve element along the direction in which the degree of openness of the air supply passage is reduced as the pressure in the intake pressure area rises, a solenoid unit that is linked to the other side of the valve element via a solenoid rod to achieve interlocked operation and applies a load to valve element along the direction in which the degree of openness of the air supply passage is reduced as the solenoid becomes excited and a means for forced opening that applies a force to the valve element along the direction in which the air supply passage is forcibly opened as the solenoid becomes demagnetized, with the valve element and the pressure-sensitive unit linked with each other in such a manner that the contact between the valve element and the pressure-sensitive unit can be established/cut off freely.

When the pressure within the pressure-sensitive chamber enters a high intake pressure condition while the solenoid at the solenoid unit remains demagnetized, the pressure-sensitive unit becomes displaced along the direction in which the degree of openness of the air supply passage is reduced. At this time, the force applied by the means for forced opening to the valve element works in the opposite direction from the direction of the displacement of the pressure-sensitive unit, thereby causing the pressure-sensitive unit and the valve element to separate from each other and sustaining the valve element at its maximum opening position. It is to be noted that the publication above discloses that the pressure-sensitive unit is constituted of a bellows and also discloses that it may alternatively be constituted of a diaphragm.

However, when utilizing a control valve having a diaphragm or a bellows to constitute the pressure-sensitive element at the pressure-sensitive unit as in the examples referred to above in conjunction with a refrigerating cycle that uses carbon dioxide as the coolant with the pressure inside the refrigerating cycle reaching a level as high as approximately 10 times that in a refrigerating cycle using freon as the coolant as in the prior art, a problem arises in that it is difficult to achieve a satisfactory degree of pressure withstanding performance at the pressure-sensitive element. There is another problem in that since it is necessary to apply the electromagnetic force of the electromagnetic actuator provided to drive the valve against a high pressure, the size of the electromagnetic actuator itself is bound to be large.

Accordingly, an object of the present invention is to provide a variable capacity control apparatus for a refrigerating cycle that implements reliable variable-capacity control while achieving a satisfactory level of coolant pressure withstanding performance against the pressure in the refrigerating cycle using carbon dioxide as the coolant without having to increase the size of the pressure control valve.

DISCLOSURE OF THE INVENTION

In order to achieve the object described above, a refrigerating cycle that uses carbon dioxide as a coolant, comprising at least a variable-capacity compressor having at least a cylinder block, a drive shaft provided inside the cylinder block, a drive swash plate that rotates together with the drive shaft and whose angle of inclination relative to the drive shaft can be varied freely, a plurality of cylinders provided within the cylinder block, each having an axis parallel to the drive shaft, a plurality of pistons slidably provided at the cylinders and caused to make reciprocal movement within the cylinders as the drive swash plate rotates, compression spaces defined by the cylinders and the pistons, a crank case formed on a non-compression side of the pistons, an intake chamber that communicates with the compression spaces during the intake phase of the pistons and an outlet chamber that communicates with the compression spaces during the compression phase of the pistons, a radiator that cools the coolant having been compressed at the variable-capacity compressor, a means for expansion that expands the coolant having been cooled by the radiator and an evaporator that evaporates the coolant having been expanded by the means for expansion, is further provided with a variable-capacity mechanism that includes at least a low pressure chamber that communicates with the intake chamber, a high pressure chamber that communicates with the outlet chamber, a pressure adjustment chamber that communicates with the crank case, a low pressure side communicating port provided between the pressure adjustment chamber and the low pressure chamber, a high pressure side communicating port provided between the pressure adjustment chamber and the high pressure chamber, a valve element that opens/closes the low pressure side communicating port and, at the same time, opens/closes the high pressure side communicating port, an electromagnetic coil that generates an electromagnetic force, a plunger that is slidably inserted at the electromagnetic coil and is moved by the electromagnetic force imparted by the electromagnetic coil to cause the valve element to move and a spring that applies a force to the valve element along the direction opposite from the direction in which the valve element is caused to move by the plunger, a pressure sensor that detects the pressure on a low pressure line extending from the outlet side of the means for expansion to the intake side of the variable-capacity compressor in the refrigerating cycle and a means for control that controls the electromagnetic coil to move the valve element along the direction in which the pressure adjustment chamber and the low pressure chamber come into communication with each other and the pressure adjustment chamber becomes cut off from the high pressure chamber if the low level pressure detected by the pressure sensor is higher than a target pressure and to move the valve element along the direction in which the pressure adjustment chamber becomes cut off from the low pressure chamber and the pressure adjustment chamber and the high pressure chamber come into communication with each other if the low level pressure is lower than the target pressure are provided.

According to the present invention provided with the pressure sensor that detects the pressure on the low pressure side of the refrigerating cycle using carbon dioxide as the coolant, the valve element is caused to move along the direction in which the value of the pressure detected by the pressure sensor is made to match the target pressure, e.g., along the direction in which the low level pressure is lowered if the detected value is higher than the target pressure and along the direction in which the low level pressure is raised if the detected value is lower than the target pressure, by controlling the electromagnetic coil. Thus, it is not necessary to include any portion with a low pressure withstanding capability such as the low level pressure detection unit in the prior art, thereby achieving higher pressure withstanding performance against the pressure in the refrigerating cycle.

In addition, according to the present invention, it is desirable to ensure that the valve element is set at a position at which it cuts off communication between the low pressure chamber and the crank case and allows the high pressure chamber and the pressure adjustment chamber to communicate with each other when no power is supplied to the electromagnetic coil and that the valve element is caused to move along the direction in which the low pressure chamber and the pressure adjustment chamber come into communication with each other and the high pressure chamber becomes cut off from the pressure adjustment chamber by the electromagnetic force imparted by the electromagnetic coil. By minimizing the compressor outlet capacity when no power is supplied to the electromagnetic coil, smoother operation is achieved during the initial stage of compressor startup.

It is also desirable to form a small hole at the valve element, through which the pressure adjustment chamber and the low pressure chamber are allowed to communicate with each other when the valve element has cut off the pressure adjustment chamber from the low pressure chamber. Since this allows a small quantity of coolant to flow toward the low pressure side from the crank case, an increase in the temperature inside the crank case is prevented.

Furthermore, the valve element includes a valve element main body provided within the pressure adjustment chamber and a guide unit extending from the high pressure side communicating port and passing through the high pressure chamber, which communicates the force imparted by the spring to the valve element main body, with a pressure, the level of which is equal to the pressure level in the low pressure chamber, supplied into a spring housing chamber housing the spring and the guide unit, pneumatically cutting off the spring housing chamber from the high pressure chamber. As a result, the low level pressure is applied to the two sides of the valve element, allowing the valve element to engage in even smoother operation compared to a valve element having different pressures applied to the two sides thereof. Thus, the operating load on the valve element is reduced and, ultimately, the electromagnetic coil can be miniaturized.

It is desirable that the control signal provided to the electromagnetic coil be a duty ratio signal with its maximum voltage restricted to a predetermined voltage level by a constant voltage circuit. By sustaining a constant voltage with the constant voltage circuit and adjusting the power level in conformance to the duty ratio when the refrigerating cycle is installed in a vehicle in which the voltage at the battery power source constituting the source fluctuates greatly, the extent to which such voltage fluctuations affect the operation of the refrigerating cycle can be minimized so that the movement of the valve element is controlled in a stable manner. Moreover, impact noise which will occur as the valve element comes in contact with the valve seat due to excessive electromagnetic force can be suppressed.

The valve stroke quantity representing the distance between the position at which the valve element blocks the low pressure side communicating port and the position at which the valve element blocks the high pressure side communicating port should be preferably set to 1 mm or smaller. By reducing the distance over which the valve element travels, the high pressure chamber and the low pressure chamber are both allowed to establish/cease communication with the pressure adjustment chamber quickly.

Moreover, it is desirable that the target pressure be calculated in conformance to the heat load environment of the refrigerating cycle to ensure that the optimal target pressure corresponding to specific air-conditioning conditions is set.

BEST MODE FOR CARRYING OUT THE INVENTION

The following is an explanation of an embodiment of the present invention, given in reference to the drawings.

Figure 1:
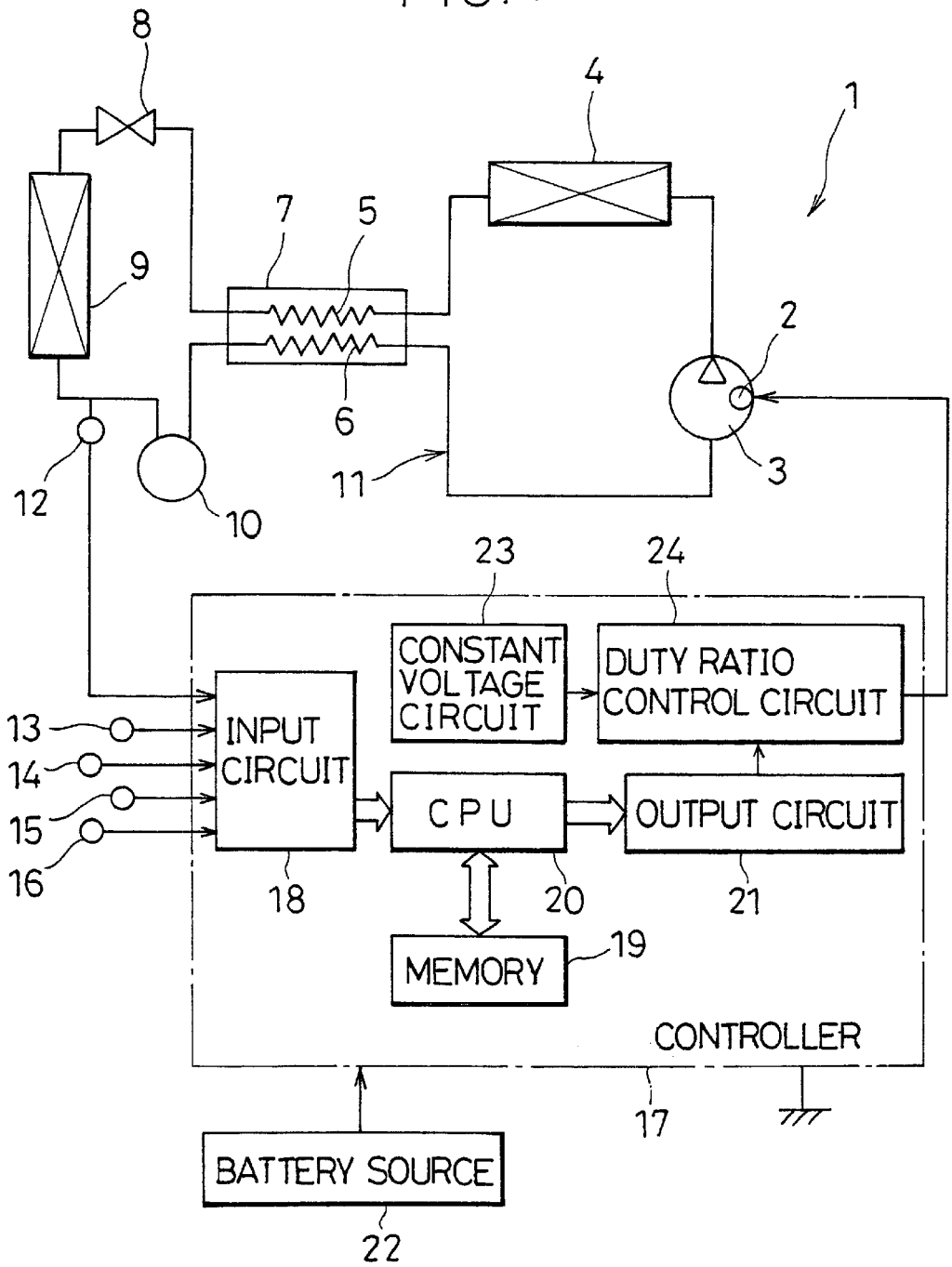
FIG. 1 is a schematic block diagram of the refrigerating cycle achieved in an embodiment of the present invention.

FIG. 1 is a schematic block diagram of a refrigerating cycle 1 which uses carbon dioxide as the coolant. The refrigerating cycle 1 comprises, at least, a variable-capacity compressor (hereafter referred to as a compressor) 3 that includes a pressure control valve 2 for varying the outlet capacity and compresses the coolant to a super-critical range, a radiator 4 that lowers the temperature of the gas-phase coolant having been compressed to the super-critical range, an internal heat exchanger 7 constituted of a high pressure side heat exchanger 5 through which the high pressure gas-phase coolant having flowed out of the radiator 4 passes and a low pressure side heat exchanger 6 through which the low pressure gas-phase coolant to be taken into the compressor 3 passes, which engages in heat exchange between the high pressure gas-phase coolant and the low pressure gas-phase coolant, an expansion valve 8 that expands the gas-phase coolant having passed through the high pressure side heat exchanger 5 to lower its pressure down to a level in the gas-liquid mixed range, an evaporator 9 that evaporates the coolant in the gas-liquid mixed state having passed through the expansion valve 8 and an accumulator 10 that achieves gas-liquid separation for the coolant evaporated by the evaporator 9 and stores any excess coolant. As a result, a refrigerating cycle 1 that absorbs the heat of the air passing the evaporator 9 provided inside an air-conditioning duct of an air-conditioning system for vehicles (not shown), for instance, and discharges the heat to the outside through the radiator 4 is realized.

In addition, a pressure sensor 12 for detecting the low level pressure is provided at a low pressure line 11 extending from the outlet side of the expansion valve 8 to the intake side of the compressor 3. The low level pressure Ps detected by the pressure sensor 12 is input to a controller 17 together with signals output by a temperature sensor 13 for detecting the external air temperature Ta and a temperature sensor 14 for detecting the cabin internal temperature Tinc, a temperature setting signal Tset provided by a temperature setting device 15 at an operating panel (not shown), the quantity of solar radiation Qsun detected by a solar radiation quantity detection sensor 16 and the like.

The controller 17 comprises at least an input circuit 18 that inputs the various signals mentioned earlier as data, a memory unit 19 constituted of a read only memory (ROM) and a random access memory (RAM), a central processing unit (CPU) 20 that obtains control data through an arithmetic operation by processing the data in conformance to a program called up from the memory unit 19 and saving the data in the memory unit 19, an output circuit 21 that outputs the duty ratio of a control signal based upon the control data calculated at the central processing unit 20, a constant voltage circuit 23 which produces a desired constant voltage by using power from a battery source 22 and a duty ratio control circuit 24 that outputs a control signal achieving the duty ratio output by the output circuit 21.

Figure 2:
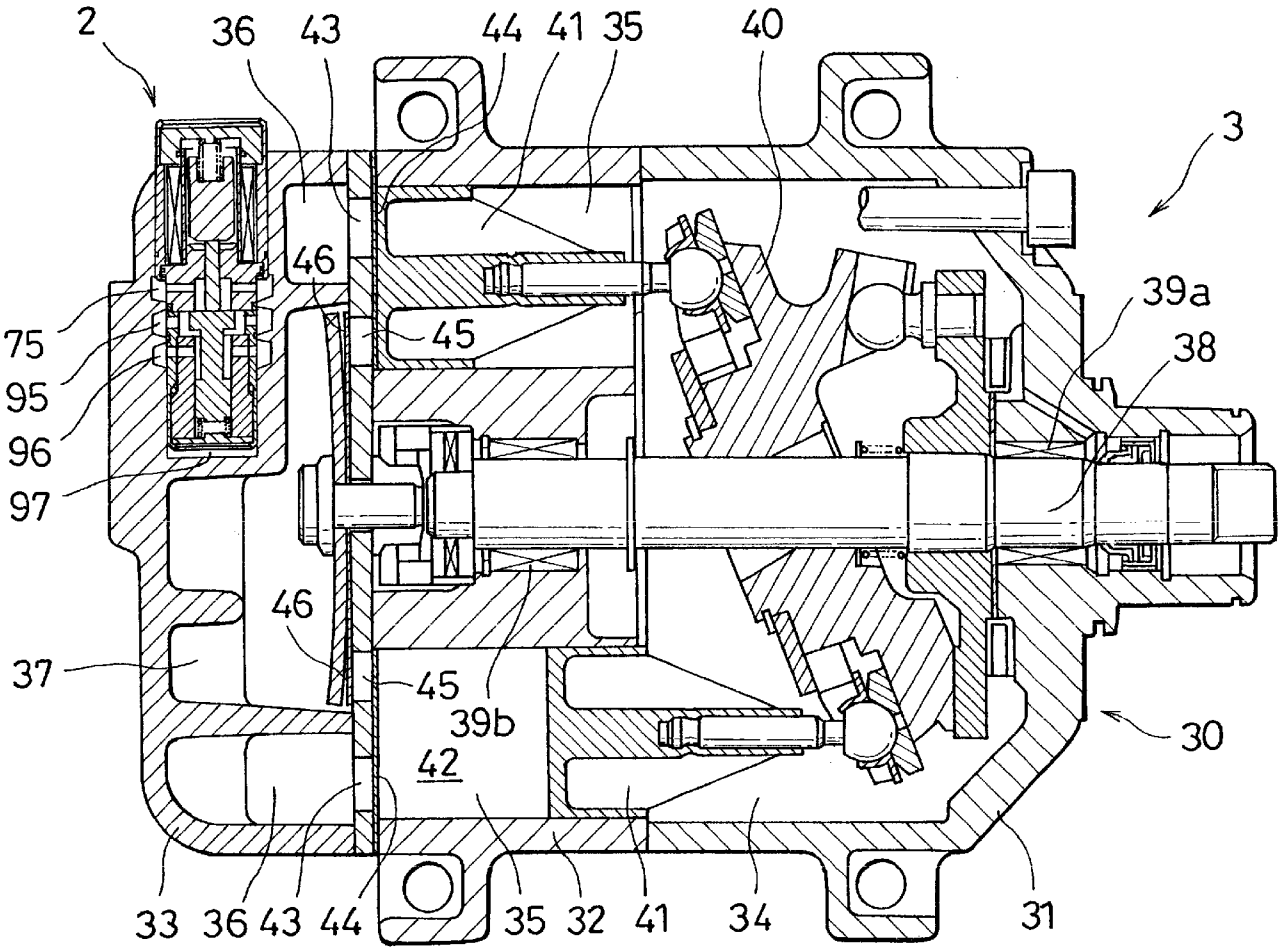
FIG. 2 is a sectional view of the variable-capacity compressor in the embodiment of the present invention.

The compressor 3, which may be, for instance, the variable-capacity swash plate compressor shown in FIG. 2, includes a outer block 30 constituted of a front block 31 defining a crank case 34, a central block 32 in which a plurality of cylinders 35 are formed and a rear block 33 defining an intake space 36 and an outlet space 37.

A drive shaft 38 passing through the outer block 30 is rotatably held at the front block 31 and the central block 32 via bearings 39*a* and 39*b* respectively. This drive shaft 38 is connected to a drive engine (not shown) via a belt, a pulley and an electromagnetic clutch, and this causes the drive shaft 38 to rotate as the electromagnetic clutch is engaged and the engine rotation is communicated thereto. In addition, a swash plate 40, which rotates together with the drive shaft 38 and can tilt freely relative to the drive shaft 38, is provided at the drive shaft 38.

The cylinders 35 are formed at the central block 32, over a specific distance from each other around the drive shaft 38. They are each formed in a cylindrical shape having a central axis extending parallel to the axis of the drive shaft 38, each having a piston 41 with one end thereof held by the swash plate 40 slidably inserted therein.

When the drive shaft 38 rotates causing the swash plate 40 to rotate while maintaining a specific angle of inclination in the structure described above, an end of the swash plate 40 swings over a specific range along the direction in which the axis of the drive shaft 38 extends. As a result, the pistons 41 secured to the front end of the swash plate 40 along the radial direction each engage in reciprocal movement along the direction in which the axis of the drive shaft 38 extends to change the volumetric capacity of a compression space 42 formed inside the corresponding cylinder 35 and, thus, the coolant is taken in via an intake port 43 having an intake valve 44 from the intake space 36 and the compressed coolant is discharged into the outlet space 37 via an outlet port 45 having an outlet valve 46.

The outlet capacity of the compressor 3 is determined by the stroke of the pistons 41, and the stroke, in turn, is determined in conformance to the pressure difference between the pressure applied to the front surface of each piston 41, i.e., the pressure in the pressure space 42 and the pressure applied to the rear surface of the piston, i.e., the pressure inside the crank case 34. In more specific terms, the pressure difference between the compression space 42 and the crank case 34 is reduced by raising the pressure inside the crank case 34 to set a smaller stroke for the piston 41 thus achieving lower outlet capacity, whereas the pressure difference between the compression space 42 and the crank case 34 is increased by lowering the pressure in the crank case 34 to set a larger stroke for the pistons 41 thus achieving a higher outlet capacity.

Figure 3:
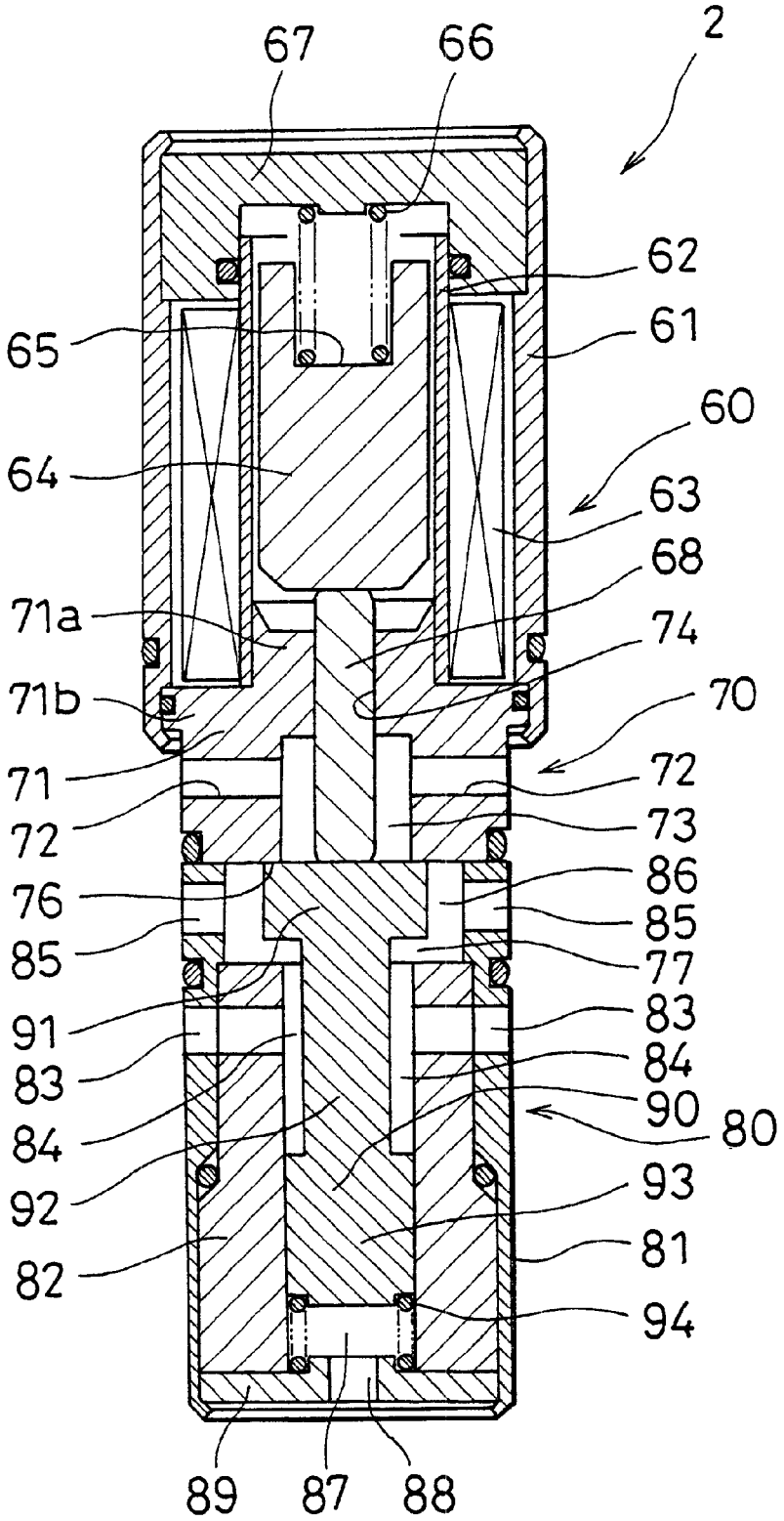
FIG. 3 is a sectional view of the pressure control valve in the embodiment of the present invention when no power is supplied thereto.
Figure 4:
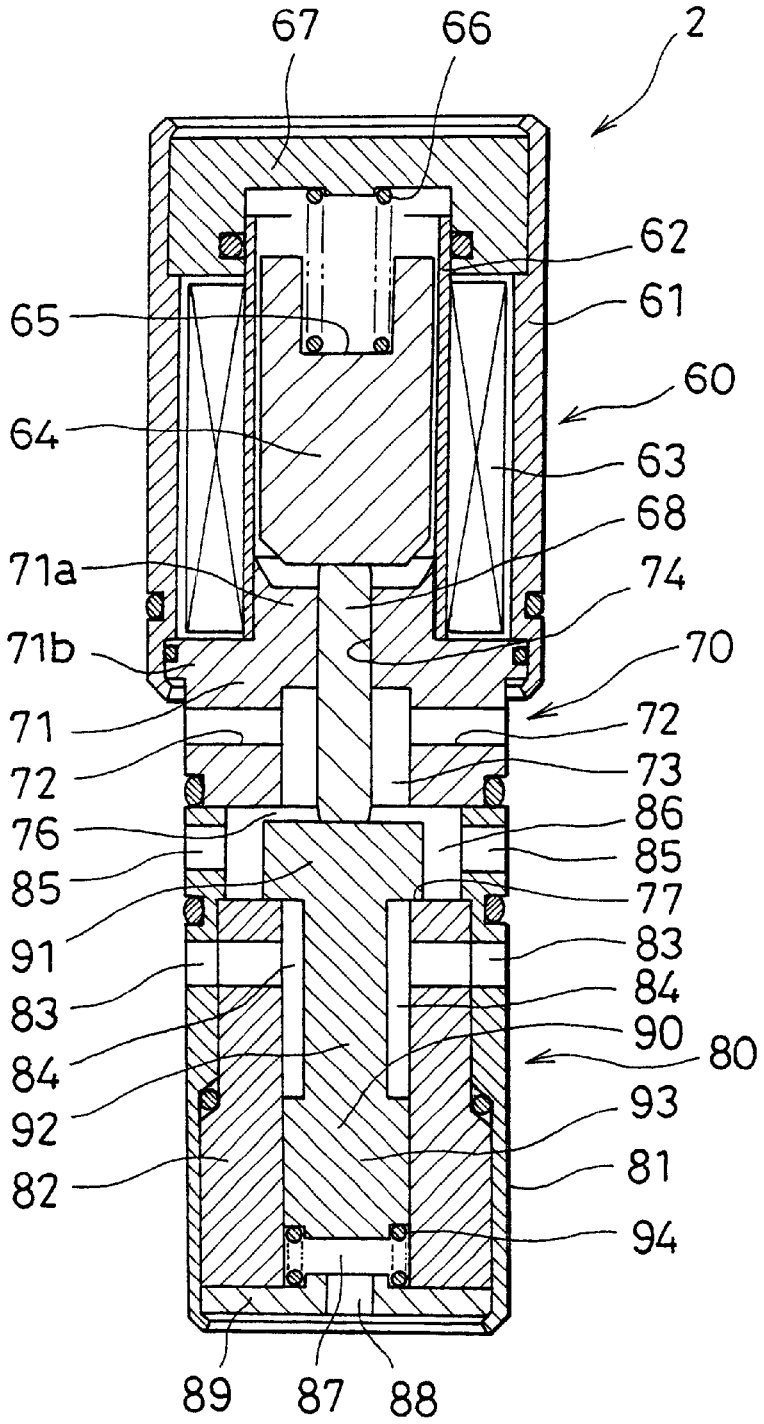
FIG. 4 is a sectional view of the pressure control valve in the embodiment of the present invention when power is supplied thereto.
Figure 5:
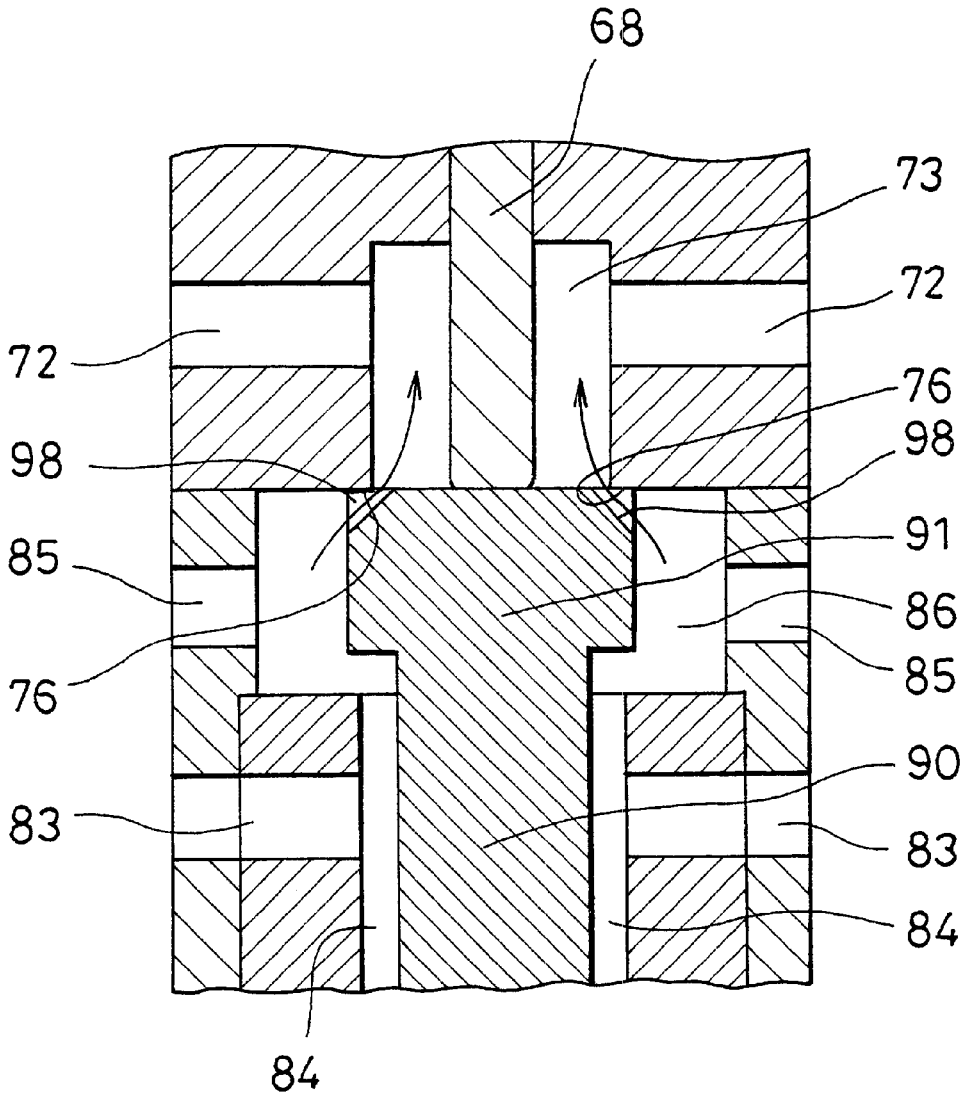
FIG. 5 is an enlarged sectional view of a portion of the pressure control valve in the embodiment of the present invention, showing the spill grooves formed at the valve element.

The pressure control valve 2 is provided at the rear block 33 of the compressor 3 in order to control the pressure in the crank case 34. This pressure control valve 2 is constituted of a drive unit 60, a central block unit 70 and a valve element unit 80 as illustrated in FIGS. 3 and 4.

The drive unit 60 includes a cylindrical case 61 which is secured through caulking to one end of the central block unit 70 cylindrically-shaped cylinder 62 housed within the case 61 and is secured to one end of the central block unit 70, an electromagnetic coil 63 wound around the cylinder 62, a plunger 64 slidably inserted at the cylinder 62 and having one end surface which comes in contact with a valve element drive rod 68 on the side where the central block unit 70 is located and another end surface at which a spring mounting hole 65 is formed, a spring 66 inserted at the spring mounting hole 65 with one end thereof placed in contact with the plunger 64 and a lid 67 holding another end of the spring 66 and secured through caulking to another end of the case 61 so as to seal the cylinder 62 on another end.

The central block unit 70 is constituted of a cylindrical block 71 having a cylindrical projection 71*a* for securing the cylinder 63 and an outer ring portion 71*b* at which the case 61 is secured through caulking at one end thereof It includes a through hole 74 at which the cylindrical projection 71*a* is formed and through which the valve element drive rod 68 slidably passes, a low pressure chamber 73 formed in a cylindrical shape at the center of the block 71 and a plurality of low pressure side communicating holes 72 extending from the low pressure chamber 73 along the radial direction. It is to be noted that since the plurality of low pressure side communicating holes 72 communicate with the intake space 36 of the compressor 3 via a first groove 75 formed at the rear block 33, the pressure inside the low pressure chamber 73 roughly matches the pressure in the low pressure line in the refrigerating cycle 1.

The valve element unit 80 includes an outer case 81 which is formed in a roughly cylindrical shape and an inner case 82 attached to the outer case 81. A pressure adjustment chamber 86 is formed and an opening/closing portion 91 of a valve element 90 is housed at the outer case 81 on the side toward the central block, and at the inner case 82 a sliding portion 93 of the valve element 90 is slidably inserted and a high pressure chamber 84 is formed between a small diameter portion 92 of the valve element 90 and the inner case 82. In addition, the pressure adjustment chamber 86 communicates with the crank case 34 via a crank case communicating hole 85 formed at the outer case 81 and a second groove 95 formed at the rear block 33, whereas the high pressure chamber 84 communicates with the outlet space 37 via a communicating hole 83 passing through the outer case 81 and the inner case 82 and a third groove 96 formed at the rear block 33.

In addition, the internal diameter of the pressure adjustment chamber 86 is set larger than the internal diameter of the low pressure chamber 73, and the internal diameter of the inner case 82 is set smaller than the internal diameter of the pressure adjustment chamber 86. As a result, a low pressure side valve seat 76 is formed between the low pressure chamber 73 and the pressure adjustment chamber 86 and a high pressure side valve seat 77 is formed between the high pressure chamber 84 and the pressure adjustment chamber 86. Then, as the opening/closing portion 91 of the valve element 90 housed inside the pressure adjustment chamber 86 becomes seated at the low pressure side valve seat 76 or the high pressure side valve seat 77, the communication between the low pressure chamber 73 and the pressure adjustment chamber 86 and between the high pressure chamber 84 and the pressure adjustment chamber 86 is established/cut off.

A low pressure space 87 is formed between an end of the sliding portion 93 of the valve element 90 and the inner case 82 to communicate with the intake space 36 via a communicating hole 88 formed at a lid 89 securing the inner case 82 to the outer case 81 and the communicating space 97 formed at the rear block 33. In addition, a spring 94 which applies a force to the valve element 90 to press it against the low pressure side valve seat 76 is provided in the low pressure space 87. It is to be noted that since the force applied by the spring 94 is set larger than the force applied by the spring 66 mentioned earlier, the opening/closing portion 91 remains pressed against the low pressure side valve seat 76 as long as no power is supplied to the electromagnetic coil 63.

Since the low level pressure can be applied to the two end surfaces of the valve element 90 along the direction in which it moves, thereby eliminating any difference in the pressure between the two ends of the valve element 90 along the traveling direction, the valve element 90 can move smoothly, which allows the level of the force applied to drive the valve element 90 to be kept down and ultimately keeps down the size of the electromagnetic coil 63 itself.

In addition, a plurality of spill grooves 98 which communicate between the pressure adjustment chamber 86 and the low pressure chamber 73 when the opening/closing portion 91 is seated at the low pressure side valve seat 76 are formed out the opening/closing portion 91 of the valve element 90. Since they allow the coolant inside the crank case 34 to flow toward the low pressure side, the temperature inside the crank case 34 does not rise.

Since the pressure inside the refrigerating cycle 1 is the equilibrium pressure between the high pressure and the low pressure at start up, the low level pressure is high at the pressure control valve 2 structured as described above, and as no power is supplied to the pressure control valve 2 as shown in FIG. 3 at start up, the outlet space 37 and the crank case 34 are in communication with each other with the pressure in the crank case 34 at all levels equal to the high-level pressure. In this situation, since the difference between the high-level pressure and the low level pressure is small, the outlet capacity is small resulting in a small drive load on the compressor 3, making it possible to startup the compressor 3 smoothly.

In addition, if the heat load on the refrigerating cycle 1 is high and thus, it is necessary to increase the capacity promptly following the initial stage of startup, power supply to the electromagnetic coil 63 of the pressure control valve 2 starts, the plunger 64 is pulled toward the electromagnetic coil 63 and the valve element block 90 is moved via the valve element drive rod 68 against the force imparted by the spring 94, thereby causing the opening/closing portion 91 to depart the low pressure side valve seat 76 and become seated at the high pressure side valve seat 77 and achieving the state shown in FIG. 4. Thus, the crank case 34 comes into communication with the intake space 36 via the pressure adjustment chamber 86 and the low pressure chamber 73 and the pressure in the crank case 34 becomes equal to the low level pressure. As a result, the stroke quantity of the pistons 41 increases as the low level pressure becomes lower, which increases the outlet capacity of the compressor 3.

Then, after the operation of the compressor 3 becomes stabilized, the pressure control valve 2 is controlled along the direction in which the outlet capacity of the compressor 3 is increased if the pressure Ps detected by the pressure sensor 12 is higher than the target pressure Psa, whereas the pressure control valve 2 is controlled along the direction in which the outlet capacity of the compressor 3 is decreased if the pressure Ps detected by the pressure sensor 12 is lower than the target pressure Psa. It is to be noted that a specific fixed value may be used for the target pressure Psa or the target pressure Psa may be determined based upon the heat load T {T=K1·F(Ta)+K2·F(Tinc)+K3·F(Qsun)−K4·F(Tset)+K5} calculated in conformance to the external air temperature Ta, the cabin internal temperature Tinc, the quantity of solar radiation Qsun, the temperature setting Tset and the like {Psa=K6·F (T)+K7}. It is to be noted that K1, K2, K3, K4 and K6 each represent an operational constant and K5 and K7 each represent a correctional term.

In addition, the duty ratio Ds for the control signal provided to the electromagnetic coil 63 is calculated through the following formula 1 based upon low level pressure Ps and the target low level pressure Psa. It is to be noted that in formula (1) below, A represents a proportional constant, P represents an integration constant and C represents a correctional term.

$$Ds=A(Ps-Psa)+B\int(Ps-Psa)dt+C \quad (1)$$

Figure 6:
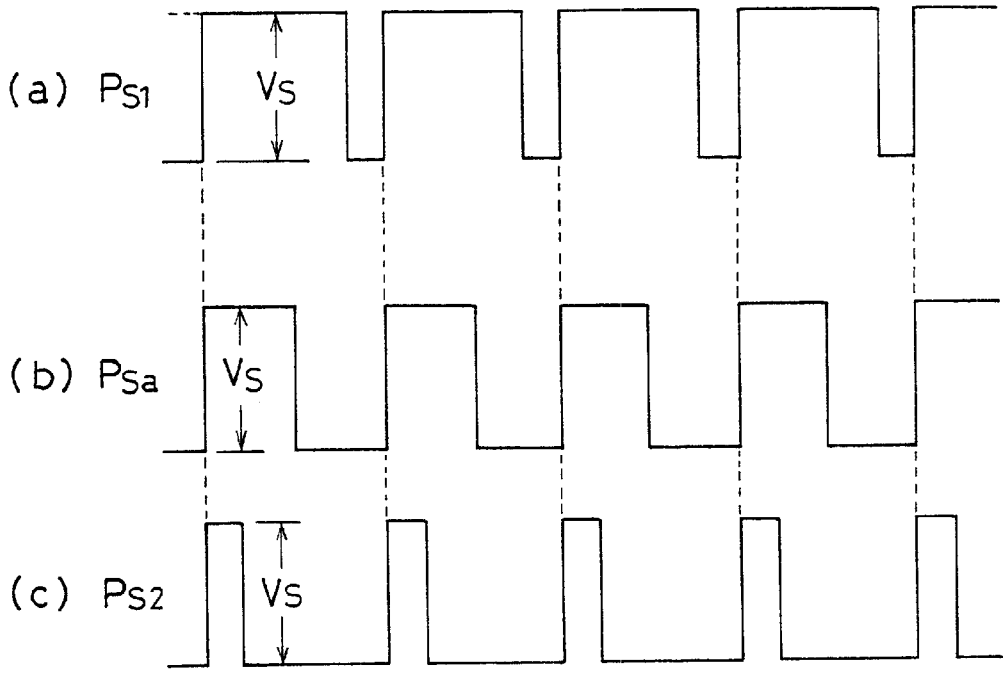
FIGS. 6(*a*), 6(*b*) and 6(*c*) present timing charts of the control signal provided to the electromagnetic coil of the pressure control valve.

Consequently, if the low level pressure Ps is higher than the target pressure Psa, a control signal achieving a large duty ratio can be obtained whereas if the low level pressure Ps is lower than the target pressure Psa, a control signal achieving a small duty ratio can be obtained, as shown in FIGS. 6(*a*), 6(*b*) and 6(*c*), for instance.

Furthermore, since the constant voltage circuit 23 is provided as described above to prevent any inconsistency in the extent of control implemented on the valve element 90 of the pressure control valve 2 from occurring due to fluctuation in the voltage at the battery source 22, accurate capacity control can be executed.

INDUSTRIAL APPLICABILITY

As explained above, according to the present invention, a separate pressure sensor for detecting the low level pressure is provided independently of the pressure control valve and thus, the pressure control valve itself does not include any portion with a low pressure withstanding capacity against the pressure in the refrigerating cycle using carbon dioxide as a coolant, thereby making it possible to lengthen the service life of the pressure control valve and achieve stable operation.

In addition, since the uniform low level pressure is applied to the two end surfaces of the valve element of the pressure control valve along its traveling direction, there is no pressure difference between the two ends of the valve element and thus, the traveling load on the valve element can be reduced, thereby allowing miniaturization of the electromagnetic coil.

Furthermore, since a minimal quantity of coolant is allowed to flow from the crank case to the low pressure side, an increase in the temperature in the crank case is minimized and the heat generated at the sliding portion of the compressor can be absorbed, to achieve an increase in the service life of the compressor itself.

Moreover, since a constant voltage is achieved for the control signal provided to the electromagnetic coil of the pressure control valve, the pressure control valve can be controlled under constant conditions, thereby making it possible to achieve a desired outlet capacity for the compressor with a high degree of reliability.

What is claimed is:

1. A variable-capacity control system for use with a refrigeration cycle that uses carbon dioxide as a coolant, said system comprising:

a variable-capacity compressor having an intake side and being operable to compress the coolant, said variable-capacity compressor comprising a cylinder block, a drive shaft provided inside said cylinder block, a drive swash plate, a plurality of cylinders provided within said cylinder block, a plurality of pistons slidably provided at said cylinders, compression spaces defined by said cylinders and said pistons, a crank case formed on a non-compression space side of said pistons, an intake chamber, an outlet chamber and a variable-capacity mechanism;

a radiator operable to cool the compressed coolant;

an expansion device operable to expand the cooled coolant and having an outlet side;

an evaporator operable to evaporate the expanded coolant;

a low pressure line extending from the outlet side of said expansion device to the intake side of said variable-capacity compressor; and a pressure sensor operable to detect pressure of coolant in said low pressure line, wherein said drive swash plate is operable to rotate together with said drive shaft and has a variable angle of inclination relative to said drive shaft, wherein each of said cylinders has an axis parallel to said drive shaft, wherein said pistons are operable to reciprocally move within said cylinders as said drive swash plate rotates, wherein said intake chamber is arranged to communicate with the compression spaces during an intake phase of said pistons, wherein said outlet chamber is arranged to communicate with the compression spaces during a compression phase of said pistons, wherein said variable-capacity mechanism comprises an electromagnetic coil operable to generate an electromagnetic force, a plunger operable to slidably insert into said electromagnetic coil as a result of the electromagnetic force, a valve element operable to move between a first position and a second position as a result of movement of said plunger, a spring operable to apply a force to said valve element along a direction opposite to a plunger moving direction, a pair of low pressure chambers located at two ends of said valve element to communicate with said intake chamber, a pressure adjustment chamber arranged to communicate with said crank case, a high pressure chamber arranged to communicate with said outlet chamber, a low pressure side communicating port provided between said pressure adjustment chamber and said low pressure chamber, and a high pressure side communicating port provided between said pressure adjustment chamber and said high pressure chamber, wherein said valve element comprises an opening/closing portion, a small diameter portion and a sliding portion, wherein said pressure adjustment chamber is formed around said opening/closing portion, wherein said high pressure chamber is formed around said small diameter portion, wherein said low pressure side communicating port is operable to close or open via one end of said opening/closing portion, wherein said high pressure side communicating port is operable to open or close via another end of said opening/closing portion, wherein when said valve element is in the first position, a fluid communication is established between said pressure adjustment chamber and said low pressure chamber and a fluid communication is not establish between said pressure adjustment chamber and said high pressure chamber, wherein when said valve element is in the second position, a fluid communication is not established between said pressure adjustment chamber and said low pressure chamber and a fluid communication is established between said pressure adjustment chamber and said high pressure chamber, and wherein said electromagnetic coil is operable to place said valve element in the first position when a coolant pressure detected by said pressure sensor is equal to or higher than a target pressure, and to place said valve element in the second position when a coolant pressure detected by said pressure sensor is lower than the target pressure.

2. A variable-capacity control system for refrigeration cycle according to claim 1, wherein said valve element includes a small hole formed therein for establishing fluid communication between said pressure adjustment chamber and one of said low pressure chambers.

3. A variable-capacity control system for refrigeration cycle according to claim 2, further comprising:

a spring housing chamber for housing said spring and having a pressure level that is the same as a pressure level in said one of said low pressure chambers, wherein said valve element further comprises a valve element main body provided within said pressure adjustment chamber and a guide unit passing through said high pressure chamber from said high pressure side communicating port and communicating a force applied by said spring to said valve element main body, and wherein said guide unit is operable to pneumatically cut off between said spring housing chamber and said high pressure chamber.

4. A variable-capacity control system for refrigeration cycle according to claim 2, further comprising:

a control signal source operable to supply a control signal to said electromagnetic coil, wherein the control signal has a duty radio for controlling a ratio of a time during which electricity is supplied to said electromagnetic coil.

5. A variable-capacity control system for refrigeration cycle according to claim 2, further comprising:

a constant voltage circuit operable to control a control signal suppled to said electromagnetic coil, wherein a voltage of the control signal does not exceed a predetermined value.

6. A variable-capacity control system for refrigeration cycle according to claim 2, wherein a valve stroke quantity from the first position of said valve element to the second position of said valve element is a maximum of 1 mm.

7. A variable-capacity control system for refrigeration cycle according to claim 2, wherein the target pressure is calculated in conformance to a heat load environment of said refrigeration cycle.

8. A variable-capacity control system for refrigeration cycle according to claim 1, further comprising:

a spring housing chamber for housing said spring and having a pressure level that is the same as a pressure level in one of said low pressure chambers, wherein said valve element comprises a valve element main body provided within said pressure adjustment chamber, and a guide unit passing through said high pressure chamber from said high pressure side communicating port and communicating a force applied by said spring to said valve element main body, and wherein said guide unit is operable to pneumatically cut off between said spring housing chamber and said high pressure chamber.

9. A variable-capacity control system for refrigeration cycle according to claim 8, further comprising:

a control signal source operable to supply a control signal to said electromagnetic coil, wherein the control signal has a duty radio for controlling a ratio of a time during which electricity is supplied to said electromagnetic coil.

10. A variable-capacity control system for refrigeration cycle according to claim 8, further comprising:

a constant voltage circuit operable to control a control signal suppled to said electromagnetic coil, wherein a voltage of the control signal does not exceed a predetermined value.

11. A variable-capacity control system for refrigeration cycle according to claim 8, wherein a valve stroke quantity from the first position of said valve element to the second position of said valve element is a maximum of 1 mm.

12. A variable-capacity control system for refrigeration cycle according to claim 8, wherein the target pressure is calculated in conformance to a heat load environment of said refrigeration cycle.

13. A variable-capacity control system for refrigeration cycle according to claim 1, further comprising:

a control signal source operable to supply a control signal to said electromagnetic coil, wherein the control signal has a duty radio for controlling a ratio of a time during which electricity is supplied to said electromagnetic coil.

14. A variable-capacity control system for refrigeration cycle according to claim 13, further comprising:

a constant voltage circuit operable to control the control signal suppled to said electromagnetic coil, wherein a voltage of the control signal does not exceed a predetermined value.

15. A variable-capacity control system for refrigeration cycle according to claim 13, wherein a valve stroke quantity from the first position of said valve element to the second position of said valve element is a maximum of 1 mm.

16. A variable-capacity control system for refrigeration cycle according to claim 13, wherein the target pressure is calculated in conformance to a heat load environment of said refrigeration cycle.

17. A variable-capacity control system for refrigeration cycle according to claim 1, further comprising:

a constant voltage circuit operable to control a control signal suppled to said electromagnetic coil, wherein a voltage of the control signal does not exceed a predetermined value.

18. A variable-capacity control system for refrigeration cycle according to claim 17, wherein a valve stroke quantity from the first position of said valve element to the second position of said valve element is a maximum of 1 mm.

19. A variable-capacity control system for refrigeration cycle according to claim 17, wherein the target pressure is calculated in conformance to a heat load environment of said refrigeration cycle.

20. A variable-capacity control system for refrigeration cycle according to claim 1, wherein a valve stroke quantity from the first position of said valve element to the second position of said valve element is a maximum of 1 mm.

21. A variable-capacity control system for refrigeration cycle according to claim 20, wherein the target pressure is calculated in conformance to a heat load environment of said refrigeration cycle.

22. A variable-capacity control system for refrigeration cycle according to claim 1, wherein the target pressure is calculated in conformance to a heat load environment of said refrigeration cycle.

* * * * *